US009072977B1

(12) United States Patent
Cutts

(10) Patent No.: US 9,072,977 B1
(45) Date of Patent: Jul. 7, 2015

(54) PLAYGROUND SWING

(71) Applicant: Powell Cutts, Houston, TX (US)

(72) Inventor: Powell Cutts, Houston, TX (US)

( * ) Notice: Subject to any disclaimer, the term of this patent is extended or adjusted under 35 U.S.C. 154(b) by 83 days.

(21) Appl. No.: 14/135,850

(22) Filed: Dec. 20, 2013

(51) Int. Cl.
*A63G 9/16* (2006.01)
*A47D 1/10* (2006.01)

(52) U.S. Cl.
CPC ..... *A63G 9/16* (2013.01)

(58) Field of Classification Search
CPC ..... A63G 9/00; A63G 9/02; A63G 9/10; A63G 9/12; A63G 9/16; A47D 1/00; A47D 1/10
USPC ..... 472/118, 120, 121, 122, 123, 124, 125; 297/273–275
See application file for complete search history.

(56) References Cited

U.S. PATENT DOCUMENTS

| | | | | | |
|---|---|---|---|---|---|
| 1,490,619 | A * | 4/1924 | Manikowske et al. | ..... | 472/120 |
| 2,513,021 | A * | 6/1950 | Harrold | ..... | 472/122 |
| 3,480,272 | A * | 11/1969 | Ziebart | ..... | 472/20 |
| 3,889,944 | A * | 6/1975 | Sapienza | ..... | 472/122 |
| 2008/0090667 | A1 * | 4/2008 | Ouellet | ..... | 472/122 |

* cited by examiner

*Primary Examiner* — Kien Nguyen

(57) ABSTRACT

A swing device and method of swinging a swing, by the person in the swing, including an arrangement adapted to transmit a downward arm force, from the person swinging to a forward and backward swinging motion. The device includes at least two hanging handles, length adjustable and guided which at its end has a means to grip by handle. Pulling on either handle at alternate times will deliver force to a force translation apparatus, which will redirect the energy from the handles into forces on the upper portion of the swing chains to pull the swing forward and backwards.

20 Claims, 4 Drawing Sheets

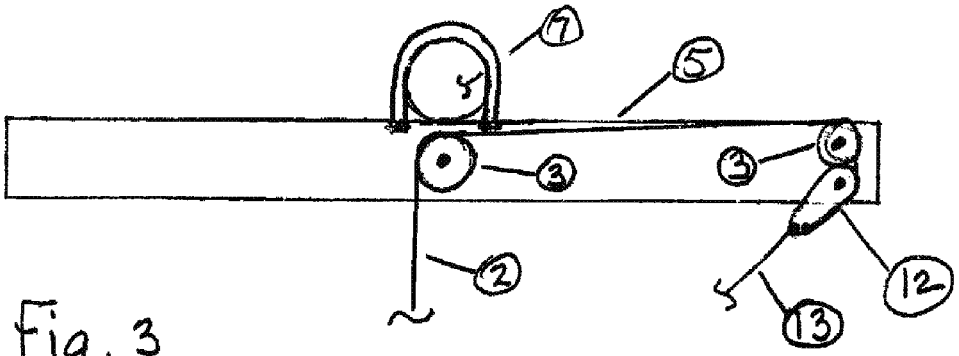
Fig. 3
Fig. 4
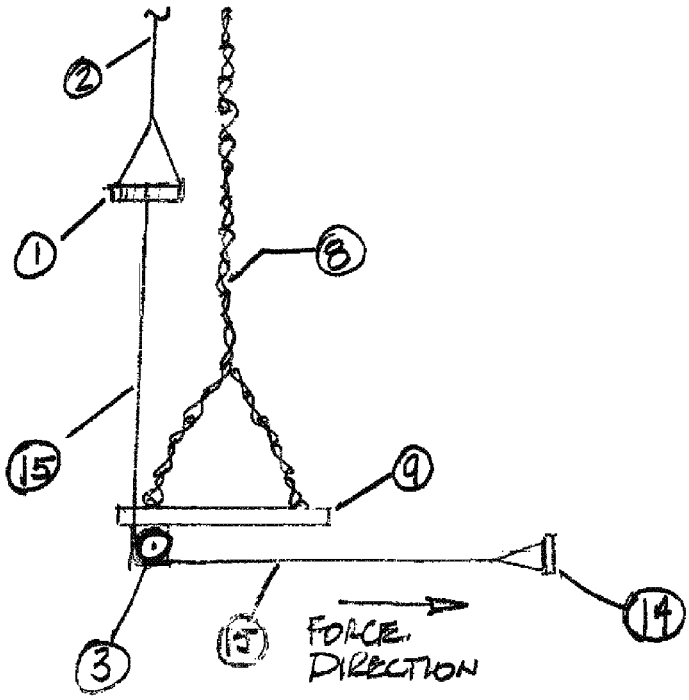

PLAYGROUND SWING

TECHNICAL FIELD OF THE INVENTION

The present invention relates to playground swings, and especially swings configured for use by handicapped persons or others wanting to swing the seat with their hands.

BACKGROUND

Swings have been around for a long time and swings are used for recreational as well as medical rehab purposes, child care, and entertainment. Common types of swings include a hard or soft seat which is suspended between ropes or chains and hung from a device that supports the swing off the ground and are capable of carrying the loads of an individual sitting in the swing as well as the forces created when using the swing. The swing is typically supported with horizontal support parallel with the swing seat. Old and young alike use swings to help exercise as well as entertain themselves and swings can be used for other purposes also. Traditionally, to begin swinging, one would force their legs forward and their upper body backwards to change the center of gravity starting the swinging motion. Others begin swinging by pushing with their feet against the ground to move to start the process and then change the center of gravity by pulling themselves backwards and forward by tucking and extending their feet and putting their upper body forward and backwards. There are other miscellaneous means of swinging, even through the assistance of a second person. What is needed are new swing configurations and methods of swinging which can present real and significant benefits to young and old individuals as well as handicapped individuals.

SUMMARY OF INVENTION

A swing design is provided including a seat which is soft and/or solid which would support an individual user suspended between two chains or ropes that are hung from a device of strength to support and hold the chains or ropes in place overhead. There is a device that is attached to the overhead support and attached to the two chains or ropes which supports two adjustable cables that come down to roughly shoulder height of the individual with stability similar to holding the traditional chains or ropes. If both handles are pulled upon, no action occurs and stability is increased, but when one handle is pulled the swing will move forward because of transposing the energy from the downward pull into a forward pull on the swing chains. The other handle will transpose its downward force to pull the swinging backwards. Pulling on the two handles alternatively, one chain and then the other, will induce movement of the user and the swing in a forward and backwards motion. In some implementations, slight rotation may be experienced in the swing seat from the forces induced, but overall the movement of the swing is forward and backwards, the same as traditional swinging.

In another embodiment of the present invention, a method provides traditional swinging with the use of arms not requiring legs and/or swinging with the use of arms combined with leg motion in such a fashion that an individual could start swinging from a stopped condition with their arms only. In another embodiment, the swinging method may incorporate the use of legs as traditional swinging to deliver more energy making the swinging event easier to start and maintain. These and other features of the invention are further described below.

BRIEF DESCRIPTION OF THE DRAWINGS

The preferred embodiments are now described with reference to the accompanying drawings in which:

FIG. 3 is a side elevation view of the torsional conversion bar and mount including cam.

FIG. 4 is a side elevation view of the swing seat with chains, ropes and handles.

DETAILED DESCRIPTION OF PREFERRED EMBODIMENTS

Figure 1:
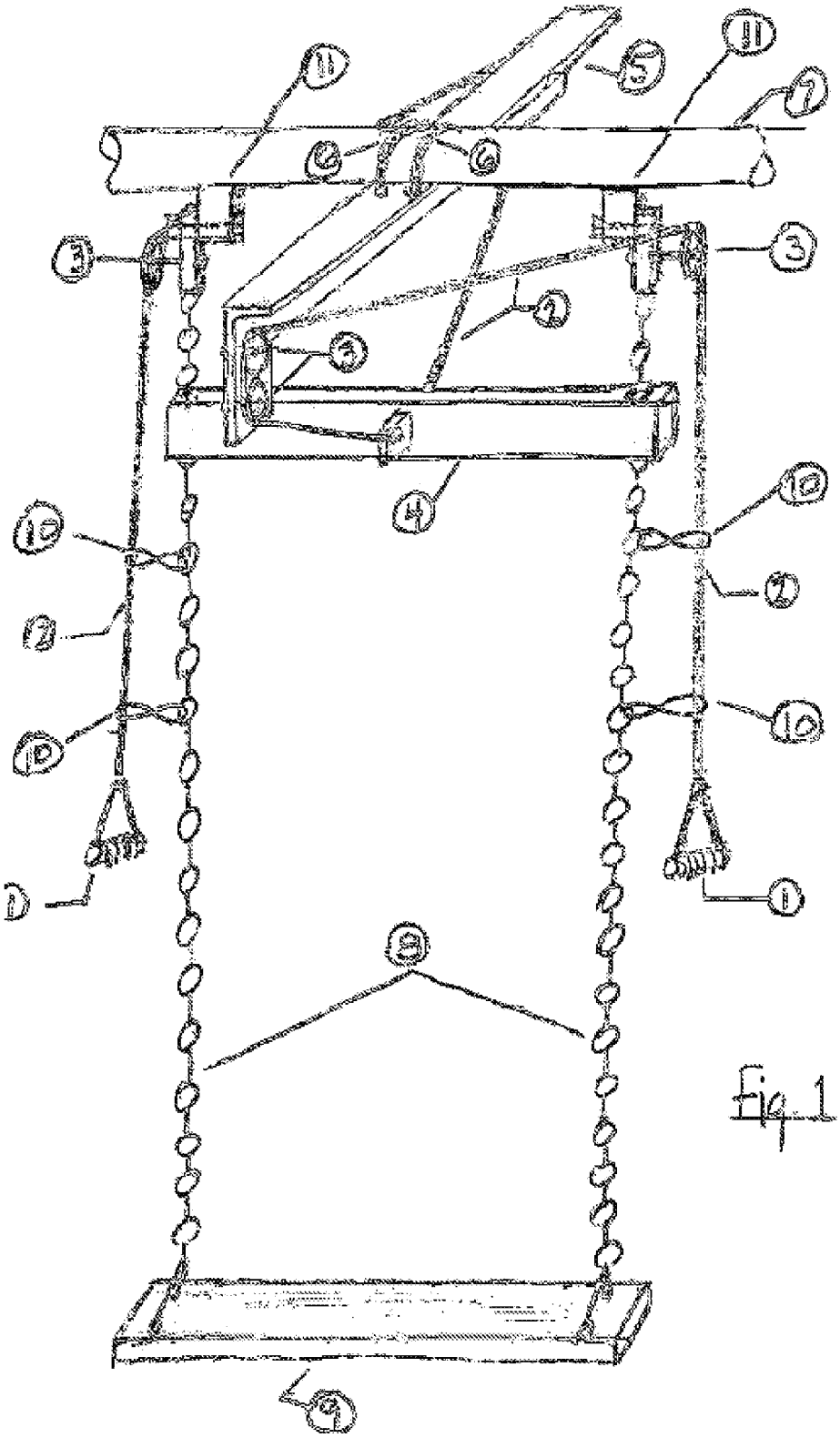
FIG. 1 is a view of the swing used in accordance with the embodiment of the swinging method of the present invention.

The construction and use of preferred embodiments is shown in the Figures, the parts of which are listed below followed by a further description of how to make and use the invention. FIG. 1 is a view of the swing used in accordance with the embodiment of the swinging method of the present invention. The perspective view of the swing mechanism includes the following components.

Figure 2:
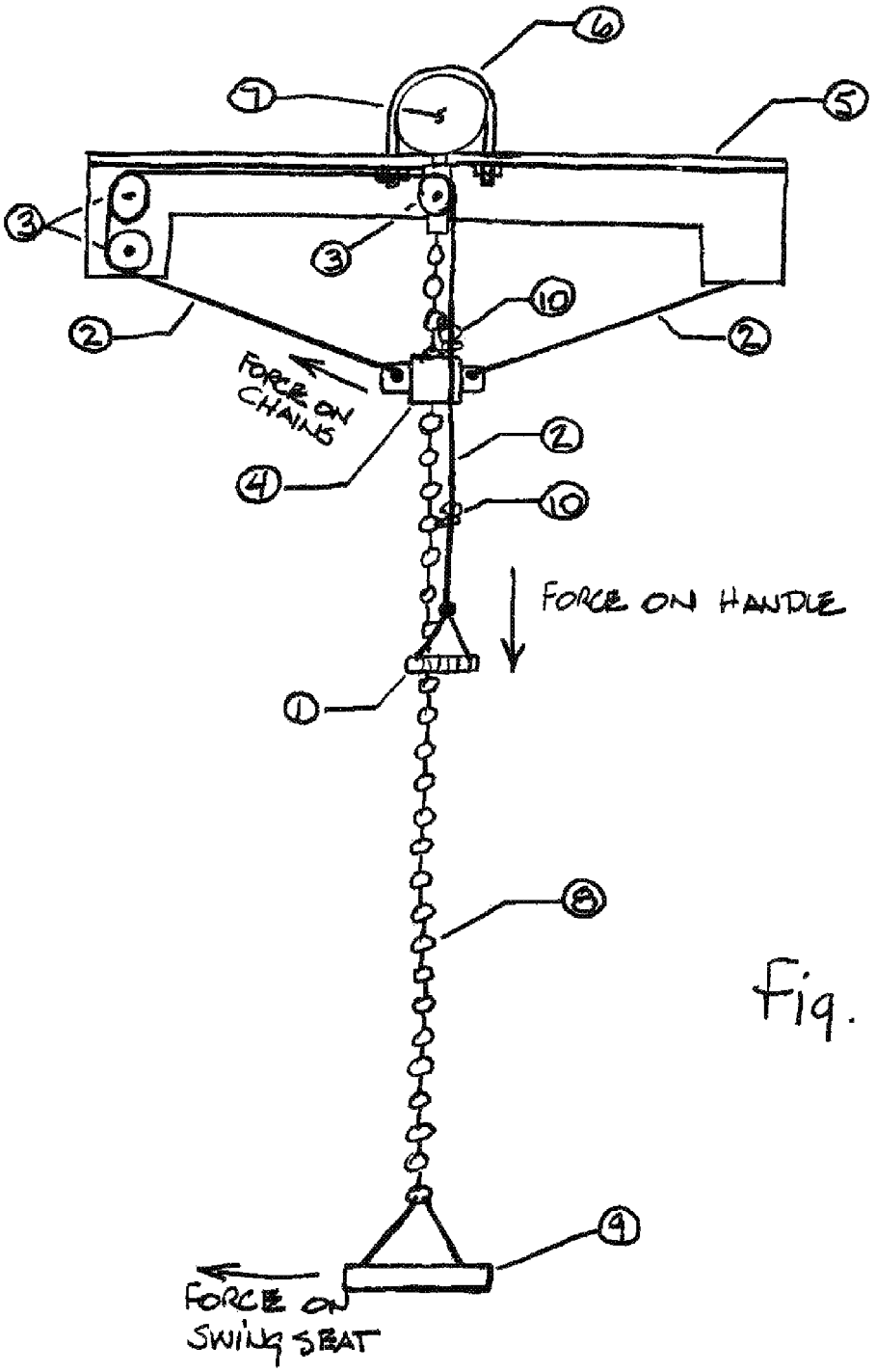
FIG. 2 is a schematic side view of the basic swing apparatus showing the direction of force generated from the handles to the swing chains and ultimately the swing seat.
Figure 5:
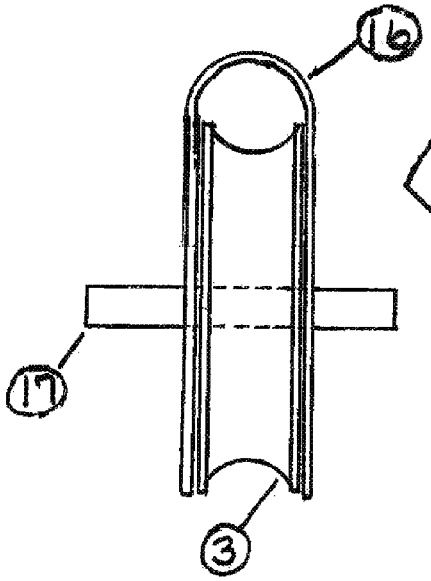
FIG. 5 is an end view of the pulley guide including a pulley guide cover.
Figure 5A:
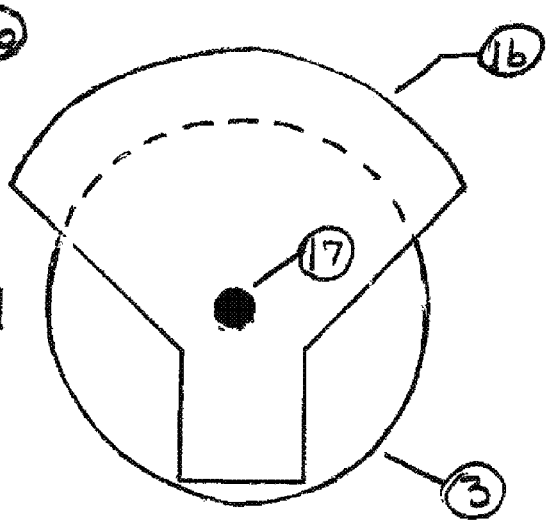
FIG. 5A depicts a side elevation view including the pulley guide cover.

Item 1. Handles
Item 2. Pull cables, ropes and chains
Item 3. Pulley guide
Item 4. Swing bar
Item 5. Torsional conversion bar and mount
Item 6. U-bolts for attachment
Item 7. horizontal cross member
Item 8. chains, ropes or cables
Item 9. Swing seat
Item 10. Pull cable guides
Item 11. attachment point FIG. 2 is a schematic side view of the basic swing apparatus showing the direction of force generated from the handles to the swing chains and ultimately the swing seat including the following components:

Item 1: Handles
Item 2: Pull cables, ropes and chains
Item 3: Pulley guides
Item 5: Torsional conversion bar and mount
Item 7: horizontal cross member
Item 8: chains, ropes or cables
Item 9: Swing seat FIG. 3 is a side elevation view of the torsional conversion bar and mount including cam with the following components:

Item 2: Pull cable, ropes and chains
Item 3: Pulley guide
Item 5: Torsional conversion bar and mount
Item 7: horizontal cross member
Item 12: Leverage cam
Item 13: Extension rod of full cable, ropes and chains FIG. 4 is a side elevation view of the swing seat with chains, ropes and handles including a foot stirrup with the following components:

Item 1: Handles
Item 2: Pull cables, ropes and chains
Item 3: Pulley guide
Item 8: chains, ropes or cables
Item 9: Swing seat
Item 14: Foot stirrups Item 15: Handle extension cable FIG. 5 is an end view of the pulley guide including a pulley guide cover with the following components: Item 3: Pulley guide Item 16: Pulley guide cover Item 17: Pulley pin FIG. 5A Depicts a side elevation view including the pulley guide cover with the following components:

Item 3: Pulley guide

Item 16: Pulley guide cover

Item 17: Pulley pin

Referring generally to the figures as set forth above, the present inventor has created, through experimentation on a conventional swing, small scale models that were constructed and life size models a new and improved swing design and accompanying method of swinging through the utilization of force generated in a downward motion by the individual swinging. The swing is of the type described above in which a swing seat, Item 9, is suspended between chains, ropes or cable, Item 8, that are hung from a substantially strong horizontal cross member, Item 7, that is stationary and attached to it a torsional conversion bar and mount, Item 5, and chains, ropes or cable, Item 8, which have pulleys, Item 3, that are adjustable hanging down with handles, Item 1, at the appropriate elevation for an individual swinging to grab to stabilize themselves and to be able to exert downward force on the handles, Item 1. This downward force would then be converted in the torsional conversion bar and mount, Item 5, to a forward and backwards force on a swing. Preferred devices incorporate a leverage cam, Item 12, type device within the pulleys, shives, wheels, sprockets, universal joints, guides, bushings or other devices to improve leverage and change the pull cable, Item 2, and/or leverage imposed on the device by the operator.

In use, the swing should be installed in such a fashion to be away from obstruction in front and behind to make the execution of swinging complete and safe. The standard method of swinging on a swing by changing the center of gravity, pushing your upper body forward and your legs back and then at the lowest point altering this to where your legs are out in front and your upper body is back can assist, is not required to be used with the new swing. The new swing can be used to swing, where at no time does the person swinging's center of gravity have to be changed or the legs utilized in the effort for pushing off or changing weight distribution. Therefore, some individuals who are handicapped, limited or too young to understand the method can enjoy swinging with just the use of their hands, with improvements and benefits in the art of swinging on a swing which can be utilized with the new swing apparatus. An additional improvement is that the swinging motion can be initiated from a dead stop in the proper forward and backwards direction without the use of legs, assistance, pushing off the ground or articulating your body weight. That is, the user can pull with one arm on the handle, Item 1, to the torsional conversion bar and mount, Item 5, and being from initial stop to pull first forward and then backwards in a proper swinging motion without other forces. Another improvement on the swinging method described above is the ability to combine the traditional swinging motion, with the new swing, adding energy to the swinging process. This could help individuals swing higher and to overcome swings that are too long to transpose the center of gravity alteration method of traditional swinging. Lastly, it should be noted that because combining the new swing energy within this new method a certain level of competition and improvement may be made available in swinging.

In construction, it should be understood that the pull cables chains, ropes or cable, can be constructed of rope, cable, chain, plastics and/or other materials that are reasonable strength to bear the forces applied by the target age of swing user. The handles, Item 1, may be attached through a variety of means such as wire, steel, plastic to the pull cables, ropes and chains, Item 2, that is transmitting the downward force. The handles, Item 1, may be manufactured and/or supplied out of a variety of materials such as rope, steel, plastic, synthetics, composite materials, nylon, chains or wire. The seat, Item 9, can be made of a variety of materials, shapes and sizes all in an effort to support the individual or multiple individuals that are being supported by the swing. The handles, Item 1, can be a collar, a strap, a knob or pull device supporting the ability of the individual swinging for the swinger to support the ability to generate the downward force. The construction may be achieved with attachment of devices to the swing chains, ropes or cable, Item 11, to accomplish direct attachment by steel bars and other devices of firm material such as wood or plastic that support the force to both lines and help to guide the operation. It can further be understood that ideally the handles are configured to have adjustable position, preferably by adjusting the length of the pull cables, which can be altered to ensure that the handles, Item 1, are at an appropriate efficient position for the swinger to energize the device.

In an alternative embodiment, the handles, Item 1, are removed and an handle extension cable, Item 15, is added down to the seat and under the seat with a foot stirrup, Item 14, that an individual could place his feet in. The foot stirrups, Item 14, would act like handles for your feet so that an individual could also generate the downward force required to energize the device. In another variation, handles, Item 1, are used together with attached foot stirrups, Item 14, as described in to support the use of hands and feet to energize the device. Other suitable variations may be made to accommodate persons with different types of handicaps. For example, the seat, Item 9, may be constructed with restraints or securing devices to more safely hold individuals with limited balance or body control such as those having paralysis in one or more parts of the body, especially the upper body. A suitable restraint or safety device may be a bar which closes down over bucket seat, such as those employed commonly on baby swings.

In yet another embodiment, whereas the torsional conversation bar is altered so that downward forces from both handles, Item 1, together pulls the swing in one direction, therefore gravity as well as an individual changing their center of gravity in the swing seat would be the only forces in the opposite direction.

Further, the invention may be provided as a retrofit or modification kit sold to go with an existing swingset, to modify the swingset as an aftermarket add-on. Such kit includes all the depicted pieces not part of a normal swingset, and further includes attachment hardware and instructions for same. In such case, it is preferred but not required that the that the first and second guide pulleys be integrated with the torsional conversion bar rather than separately attached to the swing set.

Any use of ordinal terms such as "first," "second," "third," etc., to refer to an element does not by itself connote any priority, precedence, or order of one element over another, or the temporal order in which acts of a method are performed. Rather, unless specifically stated otherwise, such ordinal terms are used merely as labels to distinguish one element having a certain name from another element having a same name (but for use of the ordinal term).

Further, as described herein, the various features have been provided in the context of various described embodiments, but may be used in other embodiments. The combinations of features described herein should not be interpreted to be limiting, and the features herein may be used in any working combination or sub-combination according to the invention. This description should therefore be interpreted as providing written support, under U.S. patent law and any know relevant foreign patent laws, for any working combination or some sub-combination of the features herein.

The above described preferred embodiments are intended to illustrate the principles of the invention, but not to limit the scope of the invention. Various other embodiments and modifications to these preferred embodiments may be made by those skilled in the art without departing from the scope of the present invention.

The invention claimed is:

1. A swing apparatus comprising:

a pair of chains, ropes or cables having first and second ends, which are attached at the first end to a horizontal cross member;

a swing seat attached at the second end of the chains, ropes or cables, adapted to support a person;

handles adapted for grabbing by the supported person, which are position adjustable and capable of transferring downward forces to a torsional conversion bar and mount via respective pull cables, the torsional conversion bar adapted for changing the force from pulling down on one pull cable to a forward swinging force and pulling down on the other pull cable to a backwards swinging force, the backward and forward swinging forces applied to a swing bar attached between the pair of chains, ropes or cables.

2. The swing apparatus of claim 1, wherein the torsional conversion bar is adapted to provide ability to initiate a swinging motion from initial dead stop by the person using only the handles.

3. The swing apparatus of claim 1, wherein the torsional conversion bar is adapted to provide swinging motion for the person using only the person's hands to provide movement force input.

4. The swing apparatus of claim 1, whereas the seat includes restraints or securing devices to more safely hold individuals with limited balance or body control.

5. The swing apparatus of claim 1, further comprising pull cable guides for holding the pull cables near the chains, ropes, or cables.

6. The swing apparatus of claim 1, in which the torsional conversion bar projects forwardly from the horizontal cross member.

7. The swing apparatus of claim 1 in which the torsional conversion bar projects backwardly from the horizontal cross member.

8. The swing apparatus of claim 1 in which the torsional conversion bar projects both forwardly and backwardly from the horizontal cross member.

9. The swing apparatus of claim 1, wherein the pull cables each pass through a respective first pulley guide attached to the horizontal cross member near the attachment of the rope, chain, or cable, the first pulley guide adapted to redirect pull force on the pull cables from a downward force to a horizontal force.

10. The swing apparatus of claim 9, wherein the pull cables each pass through a respective second pulley guide attached to the torsional conversion bar, the second pulley guide adapted to redirect pull force on the pull cables from the horizontal force to a swing force acting on the swing bar.

11. The swing apparatus of claim 1, wherein the handles, are located on either side of the person swinging.

12. The swing apparatus of claim 1, wherein at least one of the handles is a foot stirrup positioned to accommodate the person's foot.

13. The swing apparatus of claim 1, further comprising two additional handles, each attached to a respective pull cable positioned to provide ability for the person to also use feet to energize the device in a normal seated swinging position.

14. The swing apparatus of claim 1, further comprising that incorporates a leverage cam type device within at least one pulley to improve leverage and increase the swing force imposed on the swing bar.

15. A swing apparatus comprising:

a pair of chains, ropes or cables having first and second ends, which are attached at the first end to a horizontal cross member;

a swing seat attached at the second end of the chains, ropes or cables, adapted to support a person;

at least one handle adapted for grabbing by the supported person, the at least one handle capable of transferring downward forces to a torsional conversion bar and mount via a respective at least one pull cable, the torsional conversion bar adapted for changing the force from pulling down on the at least one handle a swinging forces applied to a swing bar attached between the pair of chains, ropes or cables.

16. The swing apparatus of claim 15, wherein only one pull cable is employed, the torsional coversion bar adapted to generate force in only one direction, the swing apparatus configured to allow gravity to pull the swing back in the opposite direction from the one direction.

17. A swingset modification kit apparatus for modifying a swingset including a pair of chains, ropes or cables having first and second ends, which are attached at the first end to a horizontal cross member, the swingset further including a swing seat attached at the second end of the chains, ropes or cables, adapted to support a person, the modification kit comprising:

handles, pull cables, and a torsional conversion bar, and a swing bar, the torsional conversion bar adapted to be attached to the horizontal cross member of the swing set, the handles adapted for being attached to the torsional conversion bar to be positioned for grabbing by the person in the swing seat, and in such position be capable of transferring downward forces to a torsional conversion bar and mount via respective pull cables, the torsional conversion bar adapted for changing the force from pulling down on both handles to a swinging forces applied to the swing bar when it is attached between the pair of chains, ropes or cables.

18. The kit of claim 17, further comprising pull cable guides for holding the pull cables near the chains, ropes, or cables.

19. The kit of claim 17, in which the torsional conversion bar projects both forwardly and backwardly from the horizontal cross member when attached.

20. The kit of claim 17, wherein the pull cables are each adapted of pass through a respective first pulley guide attached to the horizontal cross member near the attachment of the rope, chain, or cable, the first pulley guide adapted to redirect pull force on the pull cables from a downward force to a horizontal force.

* * * * *